United States Patent [19]

Rhoads

[11] Patent Number: 4,656,976

[45] Date of Patent: Apr. 14, 1987

[54] HYDRAULIC ROCKER ARM

[76] Inventor: Gary E. Rhoads, 8565 Boulder Dr., La Mesa, Calif. 92041

[21] Appl. No.: 585,261

[22] Filed: Apr. 1, 1984

[51] Int. Cl.[4] ..... F01L 9/02

[52] U.S. Cl. ..... 123/90.12; 123/90.15

[58] Field of Search ..... 123/90.11, 90.12, 90.13, 123/90.15

[56] References Cited

U.S. PATENT DOCUMENTS

| | | | |
|---|---|---|---|
| 1,792,795 | 2/1931 | Almen | 123/90.12 |
| 1,903,083 | 3/1933 | Almen | 123/90.12 |
| 1,930,260 | 10/1933 | Almen | 123/90.12 |
| 2,063,882 | 12/1936 | Noble | 123/90.12 |
| 2,384,701 | 9/1945 | Schreck | 123/90.12 |
| 2,396,392 | 3/1946 | Schreck | 123/90.12 |
| 2,962,013 | 11/1960 | Reggio | 123/90.13 |
| 3,727,595 | 4/1973 | Links | 123/90.12 |
| 3,865,088 | 2/1975 | Links | 123/90.12 |
| 3,872,844 | 3/1975 | Gates | 123/90.12 |
| 4,009,695 | 3/1977 | Ule | 123/90.13 |

*Primary Examiner*—Ira S. Lazarus

[57] ABSTRACT

A new and useful rocker arm for an internal combustion engine and more particularly a hydraulic actuated rocker arm of which varies valve timing automatically. Improving low end horsepower by altering valve opening and closing points, while engine speeds increase, valve duration and overlap increases automatically for a large fuel flow improving top end horsepower. This novel device also improves fuel economy and helps eliminate smog pollutant emissions to a minimum.

8 Claims, 3 Drawing Figures

HYDRAULIC ROCKER ARM

BACKGROUND AND SUMMARY OF THE INVENTION

In an internal combustion engine, the valve train comprises a mechanical steel rocker arm located on the cylinder head, a push rod agitates in a up and downward motion of which seats in a valve lifter, driven by a camshaft. The push rod pushes on one end of the rocker arm, pivoting on a supported member located on the cylinder head, and in turn opens the engines valves when pushed upwardly. These units are fixed, a conventional system following the pattern of the camshaft. However, with high performance cams the valves are timed to have considerable overlap and duration in order to provide for a large fuel flow through the engine. At low speeds this large overlap is not necessary and the engine runs inefficiently, resulting in a loss in low speed horsepower. Basically, increasing the valve lash will shorten valve open duration and reduce overlap, increasing crankshaft rotating degrees in relationship to the opening of the valves. This results in an improvement in low speed performance. However, excessive lash causes considerable noise, wear and loss of horsepower at higher revolutions per minute.

The novel hydraulic rocker arm varies valve timing automatically, by increasing or widening valve lash at low speeds, improving low and torque horsepower, economy and smog pollution emissions, yet while engine speeds increase valve lash decreases, consequently lengthening valve duration and overlap improving high speed performance.

BRIEF DESCRIPTION OF THE INVENTION

The main object of the novel invention resides in the provision of a hydraulic rocker arm.

Another object of the invention is the provision of a dual piston operated rocker arm.

Another object of the invention is the provision of a dual cylinder unit comprising three pistons, the third pistion of which operates the automatic variable valve lift control.

Another object of the invention is the provision of a single cylinder body whereby a regulated pressure forces the piston to open and close the valves automatically.

Yet a further object of the invention is the provision of adjustments, regulating bleed rates, volume change rates and incoming adjusting means, whereby these adjustments control the timing means for opening and closing the valves automatically.

DETAILED DESCRIPTION OF THE PREFERRED EMBODIMENTS

Figure 1:
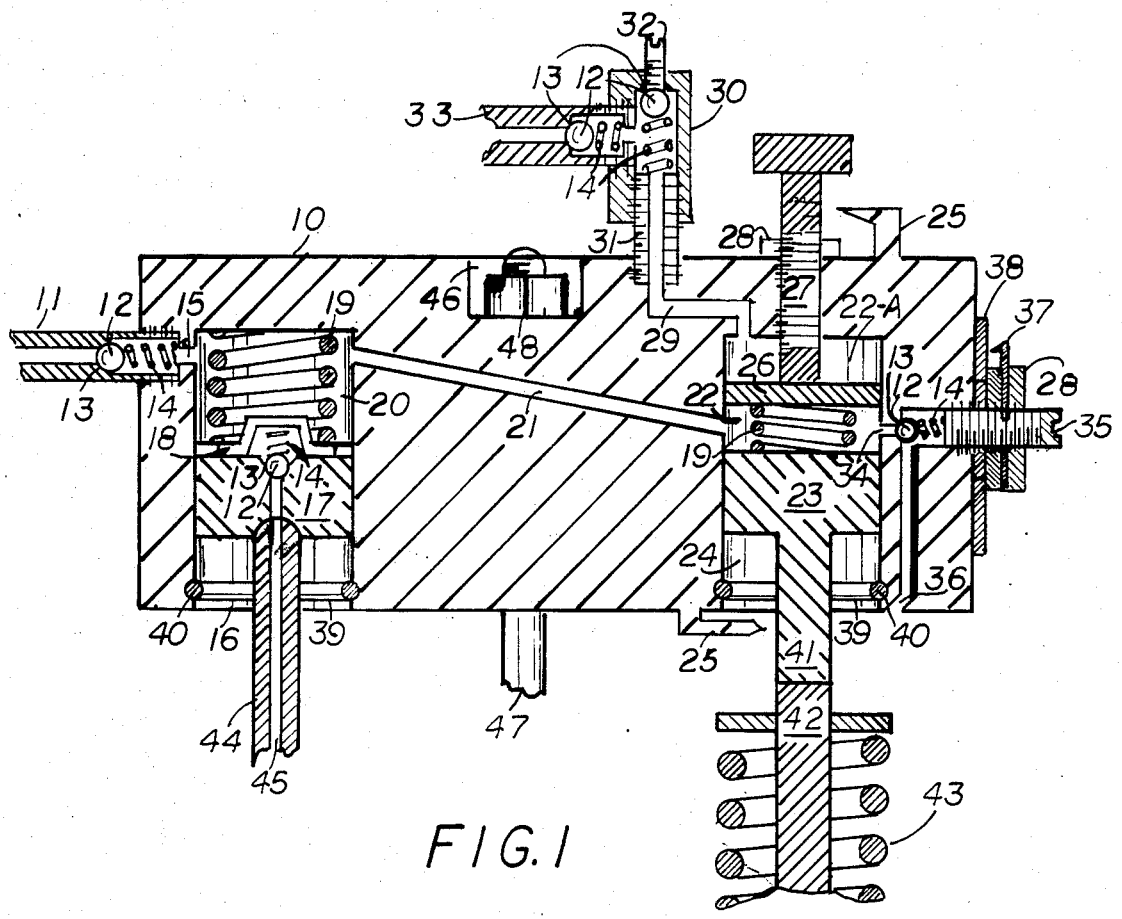
FIG. 1 is a end sectional view of the preferred embodiment.

FIG. 1 shows the preferred embodiment 10 having oil line feed supply means 11 inserted therein a check valve 12 of which rest on a valve seat 13, held in place with a spring 14, oil is omitted through port 15 feeding primary cylinder 16 whereby a primary piston 17 rides in said cylinder having the check valve held by a peripheral retainer cage 18 and a inner plunger spring 19 keeps the primary piston tightly pressed against the engines valve train operated push rod 44, and in some applications having an oil feed 45 through push rod 44. The plunger or piston 17 after having been fed with oil on the upward stroke, forces oil through oil feed gallery 21 from the oil being compressed in the primary pressure chamber 20, allowing secondary piston 23 to activate opening engine valve 42. Secondary piston 23 shows a extended steam 41 of which contacts valve steam 42 being held by the entire engine valve assembly 43 showing the lower portion broken away. Normal valve lash is adjusted between the valve steam 41 and 42 to allow for normal recommendations. Thus to adjust for valve lash in this novel unit is done by the check valve system located just outside the secondary pressure chamber 22, oil travels through bleed duct 34 having a check valve 12, a spring 14 pushing against a seat 13 by the fine tuning oil bleed delay adjusting screw 35, escaping oil of which leaks out causing a delay to take place, travels down a oil bleed channel 36, inturn lubricating the engine valve system 43. The valve lash adjustment system has a calibrated face plate 38 attached to said embodiment 10 fine tuning pointer 37 attached to the fine tuning adjusting screw 35 and locked by lock nut 28. This unit also is equipped with a valve lift metering system of which changes valve lift manually or automatically as engine rpms climb. Oil is fed through incoming oil line 33 to oil gallery 29 which feeds and allows a bleed, oil is fed to a second piston 26 located in the secondary pressure chamber 22 being held upward by a spring 19 against the upper adjusting screw 27 and locked by a nut 28, having a third pressure chamber 22-A. As engine rpms increase oil is fed to piston 26 allowing a downward motion increasing valve lift for top end horsepower whereby the valves open further accepting a larger fuel flow, while engine rpms decrease the leak down rate increases through the check valve body 30, this is adjusted by a check valve release screw 32. Check valve fitting 31 holds a dual check valve system 30. The embodiment 10 has located in each cylinder a groove 39 and inserted therein a snap ring 40 holding all internal parts together as a unit. Located on the top of said embodiment is a recessed bolt hole 46 which engages to the engines rocker arm stud 47 located on the cylinder head on some engines, a lock nut 48 tightly secures said embodiment to the cylinder head of the engine.

Figure 2:
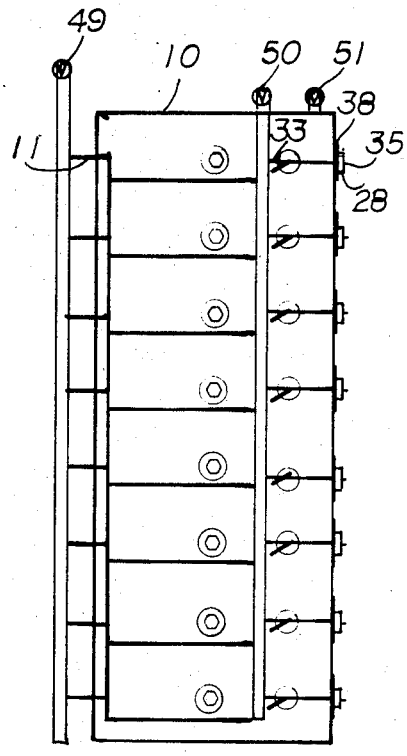
FIG. 2 is a plan top view in schematic form.
Figure 3:
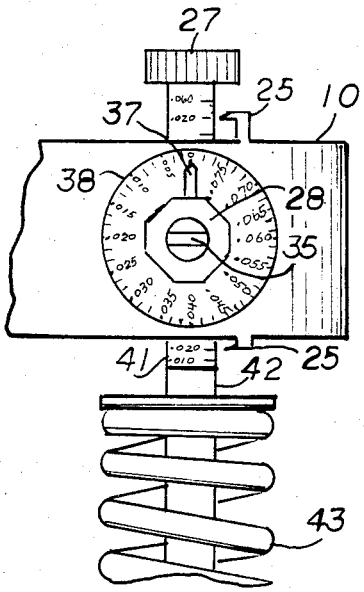
FIG. 3 is a side view with a portion broken away.

FIG. 2 shows from a top view the preferred embodiment 10 having main feed lines. Main primary feed 49, main lift feed 50, main bleed escape 51 all having adjusting means whereby one screw will adjust the bleed rate for all cylinders after individually being fine tuned. Showing a source to feed said unit in schematic form. FIG. 3 shows fine tuning adjustments, bleed and lift.

The device as shown can of course by modified within the scope of the appended claims and specifically here are some modifications which might be desirable.

The unit may be a solid unit as shown or individual units attaching to the cylinder head. The units maybe equipped with or without the valve lift actuating means. Also the unit maybe equipped only with the secondary side, eliminating the primary actuating piston. A high pressure supply properly timed pump system would attach to the unit eliminating the push rod altogether and other related components such as the camshaft and valve lifters. Electronic solenoid switches may also regulate the oil incoming source, and valve actuating means. Also fuel may directly feed intake combustion chamber through this system. A two-way valve may be inserted in body 30 to eliminate two separate valves. The oil, fluid and electricity is hereby represented by a medium mass. Check other patent pending U.S. Ser. No. 583,998 filed Feb. 27, 1984 complete computerized valve system.

Although I have described my invention with a certain degree of particularity, it is understood that the present disclosure has been made only by way of example and that numerous changes in the details of construction and the combination and arrangement of parts may be resorted to; without departing from the spirit and the scope of the invention as hereinafter claimed.

What is claimed is:

1. A stationary hydraulic rocker arm assembly comprising:

a housing;

a first piston cylinder having a top wall and being mounted in said housing, a first piston having a top surface and a bottom surface and being positioned within said first piston cylinder, a first fluid chamber formed between the top surface of said first piston and the top wall of said first piston cylinder, means on the bottom surface of said first piston for receiving the top end of a rod;

means for supplying hydraulic fluid to said first fluid chamber;

a second piston cylinder having a top wall and being mounted in said housing, a primary piston having a top surface positioned within said second piston cylinder, a primary fluid chamber formed in said second piston cylinder above the top surface of said primary piston;

means for transmitting hydraulic fluid from said first fluid chamber to the primary fluid chamber in said second piston cylinder when said first piston in the first piston cylinder is caused to travel toward the top wall of said first piston cylinder, the hydraulic fluid that is transmitted to said primary fluid chamber causes said primary piston to travel downwardly and since the bottom of the primary piston would be engaging the top end of an engine valve this will cause the valve to travel downwardly thereby opening it from its valve seat; and means in said stationary hydraulic rocker arm assembly for performing a delay in valve duration, valve lift and valve overlap at low engine rpm and which as the engine rpms increases, the valve duration, valve lift and valve overlap are automatically increased.

2. A stationary hydraulic rocker arm assembly as recited in claim 1 wherein said means for performing a delay in valve duration, valve lift and valve overlap at low engine rpm and which as the engine rpms increases, the valve duration, valve lift and valve overlap are automatically increased comprises:

a hydraulic fluid bleed duct connected to the interior of said primary fluid chamber, said bleed duct having a predetermined cross-sectional dimension which allows a predetermined volume of hydraulic fluid to be bled out of said primary fluid chamber in response to the transmitting of hudraulic fluid from said first piston cylinder to said second piston cylinder.

3. A stationary hydraulic rocker arm assembly as recited in claim 1 further comprising means in said first piston cylinder between the top surface of said piston and the closed top wall of said piston cylinder for limiting the upward travel of said piston.

4. A stationary hydraulic rocker arm assembly as recited in claim 1 further comprising check valve means for preventing hydraulic fluid from flowing back through said means for supplying hydraulic fluid to said first fluid chamber.

5. A stationary hydraulic rocker arm assembly as recited in claim 1 further comprising check valve means for closing said hydraulic fluid bleed duct and means for varying the pressure required to open said check valve means.

6. A stationary hydraulic rocker arm assembly as recited in claim 1 further comprising a secondary piston positioned within said second piston cylinder, said piston having a top surface, said secondary piston also having a bottom surface that is spaced upwardly from the top surface of said primary piston, means between the bottom surface of said secondary piston and the top surface of said primary piston to prevent their being compressed together in surface to surface contact.

7. A stationary hydraulic rocker arm assembly as recited in claim 6 further comprising a secondary fluid chamber between the top surface of said secondary piston and the top wall of said second piston cylinder, means for supplying hydraulic fluid to said secondary chamber.

8. A stationary hydraulic rocker arm assembly as recited in claim 1 further comprising means for attaching said housing to the rocker stud arm of an internal combustion engine.

* * * * *